United States Patent [19]

Barthelmess

[11] Patent Number: 4,673,134

[45] Date of Patent: Jun. 16, 1987

[54] AGITATING MILL, PARTICULARLY AGITATING BALL MILL

[75] Inventor: Ulrich Barthelmess, Niederstotzingen, Fed. Rep. of Germany

[73] Assignee: Omya GmbH, Cologne, Fed. Rep. of Germany

[21] Appl. No.: 796,238

[22] Filed: Nov. 8, 1985

[30] Foreign Application Priority Data

Nov. 9, 1984 [DE] Fed. Rep. of Germany ..... 3440993

[51] Int. Cl.[4] ..... B02C 17/16

[52] U.S. Cl. ..... 241/57; 241/79.1; 241/80; 241/171; 241/172; 241/180

[58] Field of Search ..... 241/57, 80, 97, 172, 241/79.1, 180, 179, 171, 58, 52, 53, 188 R

[56] References Cited

U.S. PATENT DOCUMENTS 1,956,293 4/1934 Klein et al. ..... 241/172 X
2,546,286 3/1951 Zakel ..... 241/188 R X

FOREIGN PATENT DOCUMENTS 1757942 7/1971 Fed. Rep. of Germany .
594294 2/1978 U.S.S.R. ..... 241/172

*Primary Examiner*—Mark Rosenbaum

[57] ABSTRACT

An agitating mill, particularly an agitating ball mill, comprising a housing having an inlet for material to be ground and for air, an outlet for fines and air, and at least one horizontal agitator shaft which is provided with agitating members. The outlet for fines and air has a large area and is provided in the top wall of the housing and extends throughout the length and width of the top wall of the housing. A plurality of agitator shafts are preferably provided which are juxtaposed and superposed.

9 Claims, 5 Drawing Figures

AGITATING MILL, PARTICULARLY AGITATING BALL MILL

BACKGROUND OF THE INVENTION

1. Field of the Invention

This invention relates to an agitating mill. Such mill is known from Published German Application No. 17 57 942.

2. Description of the Prior Art

In the known mills of that kind the inlet is disposed in or close to one end of the substantially cylindrical housing or grinding vessel and the outlet is disposed in or near the opposite end. The inlet and outlet consist of tubular ports.

Mills in general are desired to have a high throughput rate and to effect a fine division, i.e., the amount of coarse particles in the outlet should be minimized.

A higher throughput rate involves a supply of more energy to the process. A major part of said energy is converted to heat and the resulting temperature rise imposes a limit on the throughput rate. If the material to be ground is supplied to the mill together with air so that the fines are discharged together with air, that air stream will effect a cooling but such cooling—and also the throughput rate—will be restricted. A disadvantage which has been recognized resides in that the outlet is relatively small so that even an operation at a restricted throughput rate will result in a relatively high velocity of flow in the outlet and, as a result, the flowing air will entrain coarse particles at a relatively high rate.

Whereas the coarse particles can be removed by a succeeding pneumatic separator, this will involve a high expenditure. For this reason, cooled air has already been used as an entraining fluid and other mills have been supplied with lumps of frozen carbon dioxide. Each of said practices involves high costs.

SUMMARY OF THE INVENTION

It is an object of the invention to provide apparatus which is of the kind mentioned first hereinbefore and is small and compact and permits a relatively high throughput rate while ensuring a fine division in the outlet. In that arrangement, the outlet is provided in the top wall of the housing, where a relatively large space is available. The outlet suitably extends substantially throughout the length and width of the top wall of the housing. Air at a relatively high rate can flow through the large outlet at a relatively low velocity so that the mill and the material being ground will be effectively cooled. Because the rate of flow through the large outlet is relatively low and uniform, the resulting fines are relatively uniform and exhibit a uniform particle size distribution. That pneumatic separator action in the outlet can be increased in that a rejecting grid is provided in the outlet and comprises inclined blades, which will retain very coarse particles (so-called tramp oversize particles) and particularly the grinding elements.

A further improvement will be achieved if the inlet is parallel to the (at least one) agitator shaft and extends substantially throughout the length of the agitator shaft. The large inlet will result in a high throughput rate. Because the inlet extends throughout the length of the mill, the entire volume is uniformly utilized. The material to be ground is suitably fed to the mill together with (entraining) air. For this reason the inlet consists of an inlet for material to be ground and for air. Just as the material to be ground, air is uniformly distributed throughout the length of the mill so that the latter will be uniformly cooled and hot spots will be avoided.

In accordance with a further feature, the agitator shaft may be hollow so that air will be sucked from the outside through the hollow shaft and will be admitted to the mill to effect a uniform cooling. For this purpose the agitating members mounted on the agitator shaft may be hollow too and may be provided with at least one air outlet. As a result, the air will be particularly evenly distributed throughout the bed of material being ground. A correspondingly uniform cooling will be effected and the finer particles of the material being ground will immediately be entrained toward the outlet so that the average residence time will be reduced just as the consumption of energy and the load which is due to the temperature rise. The throughput rate will be increased.

Because the problem relating to temperature rise and cooling has been solved, a further feature of the invention resides in that a plurality of juxtaposed agitator shafts are provided, preferably in two rows of three agitator shafts each. Such an arrangement will increase the throughput rate which can be achieved in a compact unit or a small space. The air which is admitted to the mill may be cooled or conditioned before and a gas other than air may be used as an alternative.

DETAILED DESCRIPTION OF THE PREFERRED EMBODIMENTS

Figure 1:
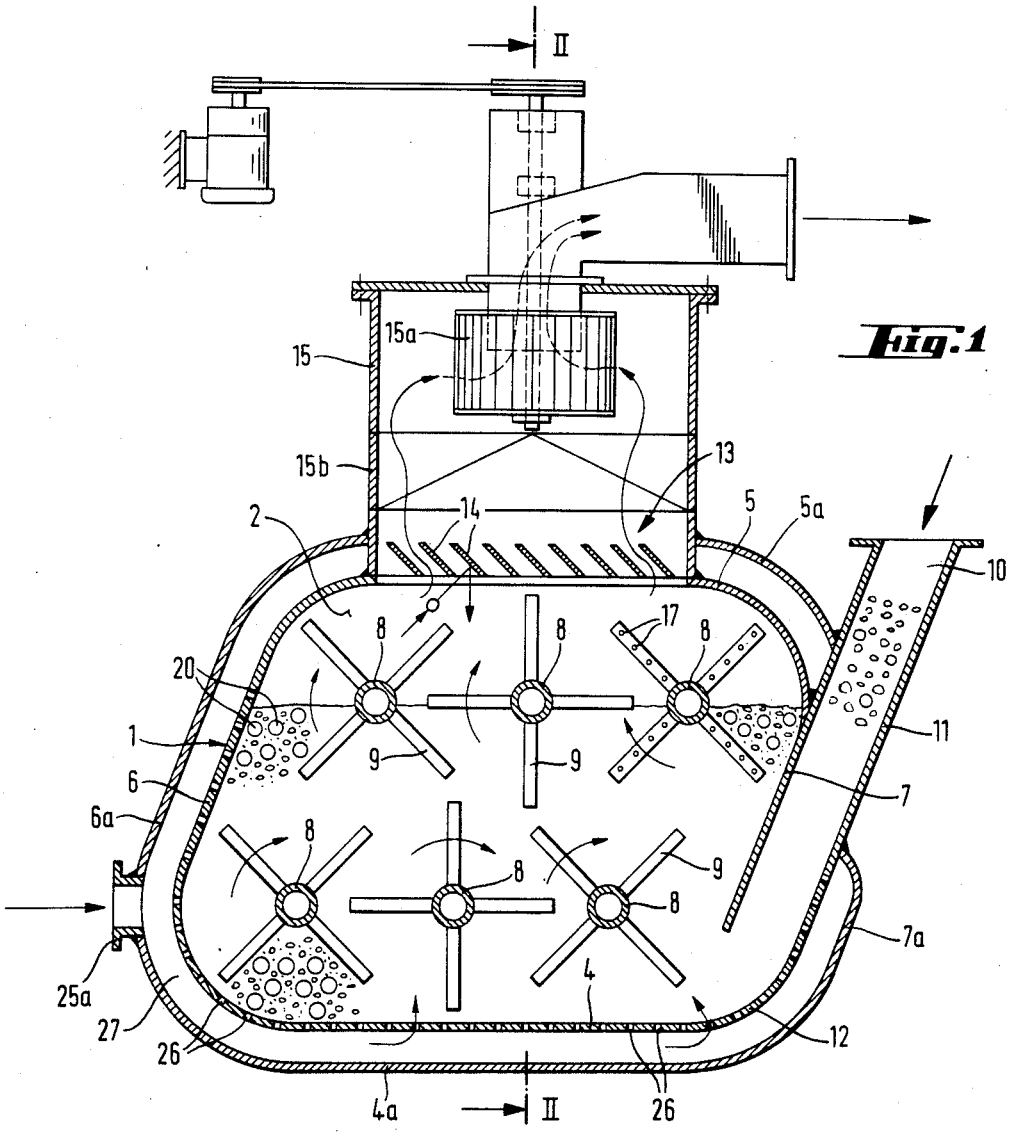
FIG. 1 is a vertical sectional view taken on line I—I in FIG. 2, which line is transverse to the agitator shafts, and illustrates a mill provided at its top with a pneumatic separator.

An illustrative embodiment of the invention will now be described with reference to the drawing.

In the illustrative embodiment, the mill in accordance with the invention comprises a substantially boxlike housing 1, which has the shape of a rhombohedron and includes two vertical end walls 2, 3, a bottom wall 4, a top wall 5 and two inclined side walls 6, 7. The edges between the inclined side walls and the bottom and top walls are rounded. That housing, which has the shape of a rhombohedron in cross-section (FIG. 1) accommodates six agitator shafts 8, which are provided with agitating members 9 and are arranged in two rows of three juxtaposed shafts each. The flight circles of the agitating arms overlap and the agitating arms are axially staggered (see FIGS. 1 and 2). The agitator shafts of the upper row are staggered relative to those of the lower row by one half of their center spacing. The inclination of the side walls 6, 7 corresponds to that axial offset. The curvature of the rounded longitudinal edges of the housing corresponds to the flight circles of the agitating arms. The inlet 10 for the material to be ground is provided on the inclined longitudinal wall 7 of the mill and consists of a chute, which extends substantially throughout the axial length of the mill (see FIGS. 1 and 2). That inlet is provided on that inclined side wall 7 which in the interior of the mill includes with the bottom wall 4 an angle in excess of 90 degrees. The outer wall 11 of the chute is parallel to the inclined inner side wall 7 and merges into the bottom wall 4 with a curvature 12. The inner side wall 7 terminates at a distance above the bottom wall 4.

The outlet 13 is provided in the top wall 5 of the housing 1 and extends substantially throughout the length and width of the top wall of the housing as far as to the curved portions. As a result, the width of the outlet 13 is approximately as large as the center spacing of the outer agitator shafts 8. A grid consisting of inclined rods or blades 14 is inserted in said large outlet opening. A pneumatic separator housing 15 is mounted over that grid of inclined rejecting blades and contains the fan wheel 15*a* of a pneumatic centrifugal separator. An adapter 15*b* provides a transition between the rectangular outlet opening 13 and the cylindrical separator housing 15. The fines flow in the direction of the arrows into the interior of the fan wheel 15a and are separated from the separating air in the usual manner by means of a succeeding filter.

The coarses fall back into the mill and are further reduced in size therein.

Figure 5:
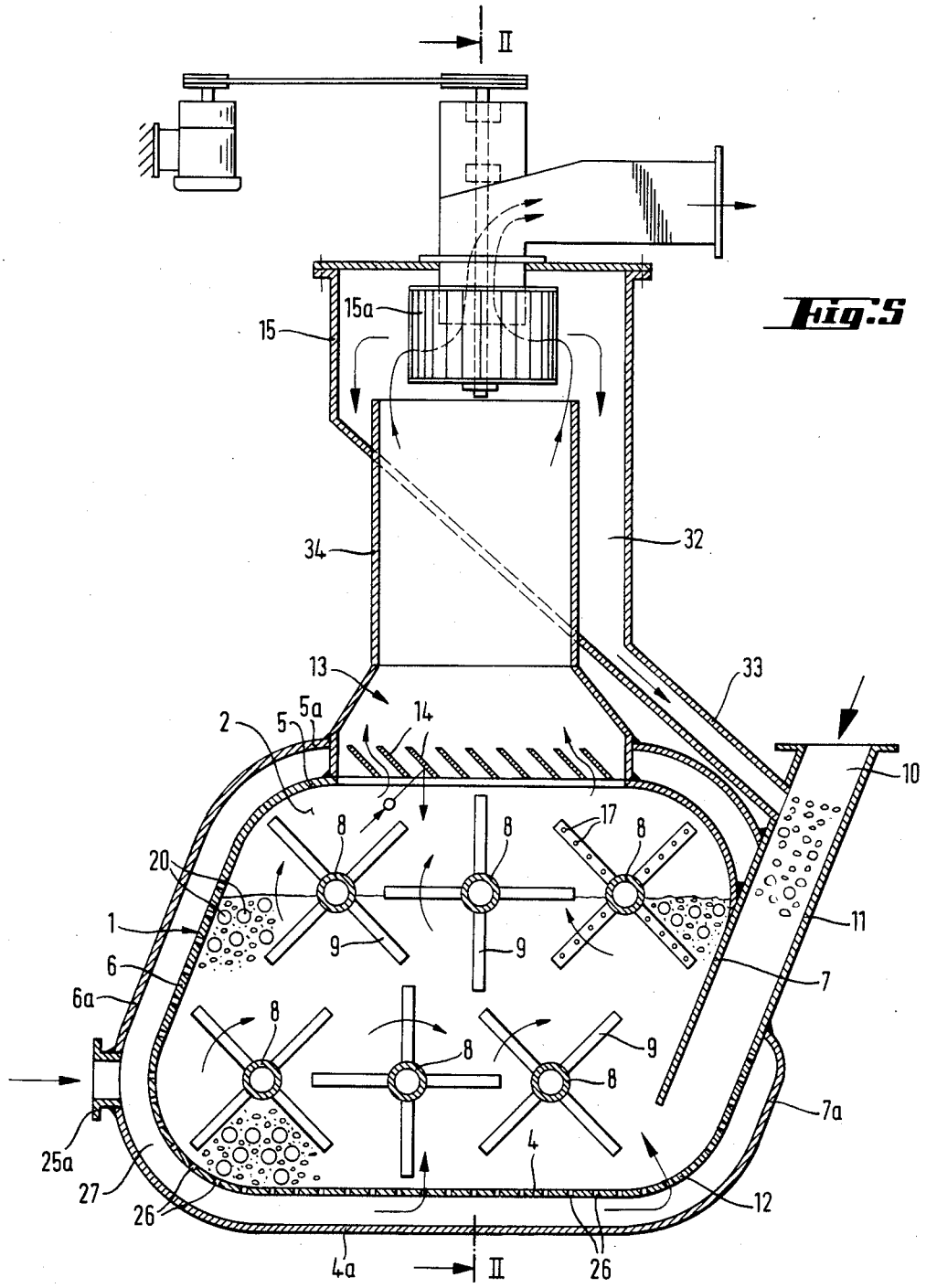
FIG. 5 is a vertical transverse sectional view showing a modification.

In the embodiment shown in FIG. 5 the coarses are recycled to the inlet 10 for the material to be ground via a hopper 32, which is attached to the bottom of the pneumatic separator housing, and an inclined pipe 33 or a chute. The pneumatic separator is disposed on a sufficiently high level above the mill and is connected by a duct 34 to the outlet 13 or the adapter 15*b*.

The shafts 8 are hollow or tubular and are provided with radial bores 16 inside the mill. The agitating arms 9 are also hollow or tubular and communicate through a radial bore with the interior of the agitator shaft 8. The agitating arms 9 have lateral openings 17 and/or are provided at their outer end with an opening 18. As a result, the interior of the mill communicates with the ambient atmosphere.

The subatmospheric pressure which is applied to the pneumatic separator 15, 15*a* at the top of the mill and/or to a succeeding pneumatic separator causes air to be sucked from the outside through the mill through the hollow shafts 8 and the hollow agitating arms 9. The provision of a large number of agitator shafts 8 and agitating arms 9 ensures that the air will be thoroughly and uniformly distributed throughout the bed of material being ground. This permits the provision of an inlet 10 which is relatively very large and particularly of a very large outlet 13. The agitating arms 9 and the air which flows at the same time into the bed of material being ground result in a loosening of the bed of material being ground so that the mobility of the grinding elements 20 will be improved. As soon as fines have been formed, they are blown virtually in a nascent state out of the bed of material being ground. It is particularly important that the bed of material being ground and the entire mill are cooled so that an excessive heating will be avoided. That cooling permits the provision of a plurality of agitator shafts 8 in superposed rows. There are virtually no limits to the dimensions of the mill as regards length, width and height because the limits previously imposed by the temperature rise are eliminated. The grinding elements and coarses are retained by the rejecting blades 14.

Figure 3:
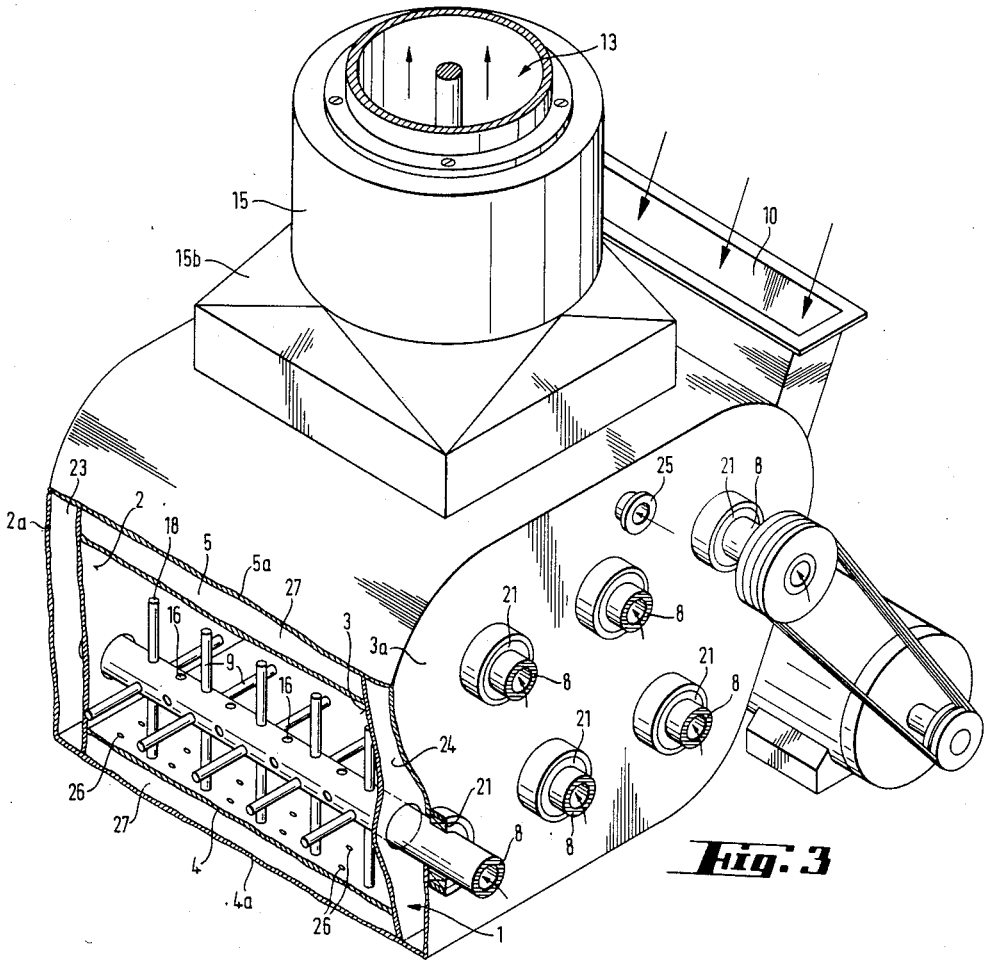
FIG. 3 is a perspective view showing the mill of FIGS. 1 and 2.

The air which has been sucked cools also the bearings. Each agitator shaft 8 may be separately driven by a separate gearmotor 22. Individual drives are less expensive than a drive which is diagrammatically indicated in FIG. 3 and comprises a correspondingly larger motor and a distributing transmission.

Figure 2:
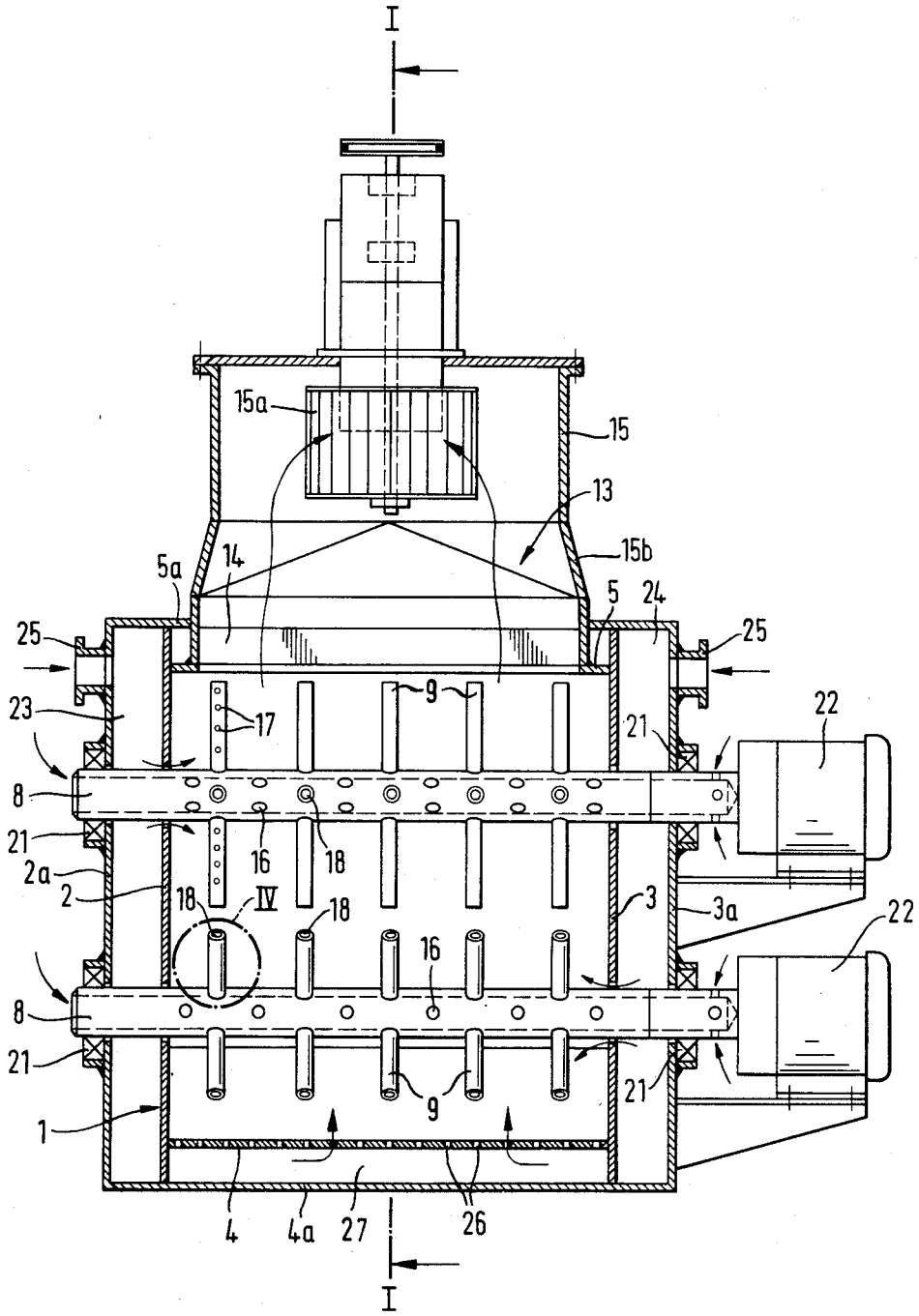
FIG. 2 is an axial sectional view taken on line II—II in FIG. 1.

In all mills an escape of fines and/or dust from the interior of the mill is to be prevented. That requirement gives rise to difficulties regarding the seals between the shafts and the housing walls. The subatmospheric pressure inside the mill opposes an escape of fines. In addition, compressed air may be provided at the shaft seals. For this purpose the end walls 2 and 3 of the illustrative embodiment are double walls, each of which consists of an inner wall and an outer wall 2*a* or 3*a* and corresponding peripheral wall portions. Compressed air is blown through a compressed air port 25 into the air chambers 23, 24 which are thus defined. The compressed air flows continuously past the shaft seals of the inner end walls 2, 3 so that an escape of fines will be additionally opposed (FIG. 2).

The material to be ground may be fed into the grinding or agitator chamber with an exclusion of air or by means of additional entraining air.

Figure 4:
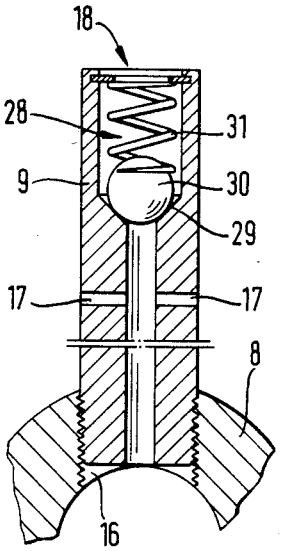
FIG. 4 shows an agitating arm as a detail indicated in FIG. 2 by line IV.

Air may also be supplied in a fine division throughout the housing. For this purpose each of the peripheral walls consisting of the inclined side walls 6, 7, the bottom wall 4 and the top wall 5 consists also of double walls, namely, an inner wall and an outer wall 4*a*, 5*a*, 6*a* or 7*a* spaced from that inner wall. The cavity 27 defined by said walls is adapted to be supplied with compressed air through a tubular port, which is mounted on the outer wall 6*a*. The inner walls are formed with openings 26 for a discharge of air. The air inlet openings 26 are mainly provided in the bottom wall 4 whereas no openings or fewer openings are provided in the upper portion of the mill. The arrangements described hereinbefore for the supply of air into the bed of material being ground may be provided individually or in combination. It is believed that the supply of air through hollow agitator shafts and hollow agitating members will be most effective. According to a further feature the agitating arms contain inserted valves for blocking a discharge of air when each agitating arm is performing the upper part of its revolution. In that case the air streams leaving the agitating members will be substantially downwardly directed rather than upwardly so that a uniform grinding action throughout the volume of the mill will be promoted. FIG. 4 shows check valves 28 incorporated in the agitating arms 9.

Each agitator arm contains a seat 29 for a valve ball 30 or a similar valve member. The valve seat is disposed radially inwardly and the valve ball is disposed radially outwardly. As a result, when the agitator arms 9 are performing the upper part of their revolution, the valve ball 30 will be forced against the valve seat by gravity, opposite to the action of centrifugal force and of the higher air pressure in the agitating arm 9, so that an escape of air will be prevented. When the agitator arm is performing the lower part of its revolution, the weight of the valve ball 30 will act in the same sense as the centrifugal force and the pressure force so that the valve ball will be spaced from the valve seat and air can flow downwardly and into the lower portion of the mill. To minimize the weight and size of the valve ball 30 and to ensure that the valve 28 will reliably be closed, a compression spring 31, shown in FIG. 4, is provided and acts also to limit the stroke of the valve.

What is claimed is:

1. An agitating mill, particularly a ball mill, comprising a housing having at least one inlet for material to be ground and for air and an outlet for fines and air, and at least one horizontal agitator shaft which is provided with agitating members, said at least one inlet being parallel to said at least one horizontal agitator shaft and extending substantially throughout the length of said at least one horizontal agitator shaft, and said outlet for fines and air extending substantially throughout the length and width of a top wall of the housing.

2. An agitating mill according to claim 1, wherein parallel, spaced apart, inclined rejecting blades are provided in the outlet as a rejecting grid.

3. An agitating mill according to claim 1, wherein a separator comprising a pneumatic centrifugal separator is disposed over the outlet.

4. An agitating mill according to claim 1, wherein the agitator shaft is hollow and is provided with at least one air intake opening outside the housing and with at least one air outlet opening inside the housing.

5. An agitating mill according to claim 4, wherein the agitating members are hollow and are provided with at least one air outlet opening.

6. An agitating mill according to claim 5, wherein the outlet openings of the agitating members are preceded by a valve comprising a valve seat and a valve ball, said valve ball being disposed between the valve seat and the respective outlet.

7. An agitating mill according to claim 1, wherein the housing is double-walled at least in part, at least one air inlet is provided in the outer wall and a plurality of inlets leading into the interior of the mill are provided in the inner wall.

8. An agitating mill, particularly a ball mill, comprising a housing having at least one inlet for material to be ground and for air and an outlet for fines and air, and a plurality of horizontal agitator shafts each of which is provided with agitating members, said agitating shafts being juxtaposed and superposed, the flight circles of the agitating members overlapping and the agitating members being correspondingly axially staggered, and said outlet for fines and air extending substantially throughout the length and width of a top wall of the housing.

9. Air agitating mill according to claim 8, wherein the agitator shafts are arranged in two rows of three shafts each.

* * * * *